US008397532B2

(12) United States Patent
Mitchell et al.

(10) Patent No.: US 8,397,532 B2
(45) Date of Patent: Mar. 19, 2013

(54) DIRECT-COOLED ICE-MAKING ASSEMBLY AND REFRIGERATION APPLIANCE INCORPORATING SAME

(75) Inventors: Alan Joseph Mitchell, Louisville, KY (US); Charles Benjamin Miller, Louisville, KY (US)

(73) Assignee: General Electric Company, Schenectady, NY (US)

( * ) Notice: Subject to any disclaimer, the term of this patent is extended or adjusted under 35 U.S.C. 154(b) by 389 days.

(21) Appl. No.: 12/906,432

(22) Filed: Oct. 18, 2010

(65) Prior Publication Data

US 2012/0090346 A1 Apr. 19, 2012

(51) Int. Cl.
*F25C 1/22* (2006.01)

(52) U.S. Cl. ..... 62/340; 62/352

(58) Field of Classification Search ..... 62/340, 62/351, 353, 344, 356
See application file for complete search history.

(56) References Cited

U.S. PATENT DOCUMENTS

| | | | | |
|---|---|---|---|---|
| 4,055,053 | A * | 10/1977 | Elfving et al. | 62/3.63 |
| 4,205,535 | A * | 6/1980 | Maurer | 62/342 |
| 4,916,921 | A * | 4/1990 | Fletcher | 62/356 |
| 6,293,107 | B1 * | 9/2001 | Kitagawa et al. | 62/3.6 |
| 6,935,124 | B2 * | 8/2005 | Takahashi et al. | 62/74 |
| 7,216,499 | B2 | 5/2007 | Flinner et al. | |
| 7,318,323 | B2 * | 1/2008 | Tatsui et al. | 62/320 |
| 7,673,474 | B2 * | 3/2010 | Athanasiou | 62/440 |
| 2003/0167787 | A1 * | 9/2003 | Ohashi et al. | 62/443 |
| 2007/0186570 | A1 | 8/2007 | Kopf | |
| 2009/0293501 | A1 | 12/2009 | Kulkarni et al. | |
| 2010/0223944 | A1 * | 9/2010 | Tsujimoto et al. | 62/264 |

* cited by examiner

*Primary Examiner* — Mohammad Ali
(74) *Attorney, Agent, or Firm* — Dority & Manning, P.A.

(57) ABSTRACT

A direct-cooled ice making assembly for a refrigeration appliance is disclosed. A refrigeration system includes a refrigerant circuit having an ice maker cooling portion for cooling an ice maker mold body. A cooling plate houses the ice maker cooling portion which creates ice within compartments of the mold body by cooling the mold body via the cooling plate. The ice maker is configured to be removably attached to the cooling plate so as to be replaceable without removing the ice maker cooling portion of the refrigerant circuit within the cooling plate or the cooling plate. Related refrigeration appliances are also disclosed.

20 Claims, 8 Drawing Sheets

DIRECT-COOLED ICE-MAKING ASSEMBLY AND REFRIGERATION APPLIANCE INCORPORATING SAME

FIELD OF THE INVENTION

The subject matter disclosed herein is related generally to direct-cooled ice-making assemblies and related refrigeration appliances, and more particularly to such assemblies and related refrigeration appliances having an ice maker that is removably attachable from a cooling plate.

BACKGROUND OF THE INVENTION

In a refrigeration appliance such as a refrigerator or freezer, several systems have been proposed for cooling of an ice maker within the refrigerator or freezer cabinet. In some systems, the ambient air within a freezer is chilled to a temperature low enough to form the ice. In other systems, known as direct-cooled systems, a cooling loop for the ice maker is added to typical the refrigeration loop. The ice maker cooling loop can be routed through the mold body of the ice maker, thereby directly cooling the ice maker to increase the rate at which ice can be formed in the ice maker. If desired, warm refrigerant can also be passed through the ice maker when ice cube are ready for harvest.

The heating and cooling loops for ice makers include portions embedded within the mold of the ice maker to provide the desired heat transfer. For example, U.S. Pat. No. 7,216,499 discloses an ice maker having a first heat exchanger 12 in the form of an ice-making mold with multiple depressions 14 for making ice cubes. Cooling fluid runs through an interior portion of heat exchanger 12, connected to the cooling loop by connectors 13.

Direct-cooled ice making systems typically operate sufficiently to create ice cubes at a much higher rate than by using cold air alone. Direct-cooled systems also provide flexibility as to where within the refrigerator or freezer cabinet the ice maker can be located. However, due to the added features provided by direct cooled systems they are inherently more complicated than other systems to manufacture and to service, in particular if any parts of the ice maker need to be replaced at a user's location. Accordingly, simplified direct-cooled ice making assemblies and/or related refrigeration appliances incorporating same would be welcome.

BRIEF DESCRIPTION OF THE INVENTION

Aspects and advantages of the invention will be set forth in part in the following description, or may be obvious from the description, or may be learned through practice of the invention.

According to certain aspects of the disclosure, a direct-cooled ice making assembly for a refrigeration appliance is disclosed including an ice maker having a mold body defining a plurality of compartments for forming ice cubes therein. A refrigeration system includes a refrigerant circuit having an ice maker cooling portion for cooling the ice maker mold body. A cooling plate houses the ice maker cooling portion which creates ice within the compartments of the mold body by cooling the mold body via the cooling plate. The ice maker is configured to be removably attached to the cooling plate so as to be replaceable without removing the ice maker cooling portion of the refrigerant circuit within the cooling plate or the cooling plate. Various options and modifications are possible.

According to certain other aspects of the disclosure, a refrigeration appliance with a replaceable direct-cooled ice maker is disclosed including a cabinet and an ice maker within an interior of the cabinet. The ice maker has a mold body defining a plurality of compartments for forming ice cubes therein. A refrigeration system includes a refrigerant circuit for cooling the interior of the cabinet. The refrigerant circuit has an ice maker cooling portion for cooling the ice maker mold body. A cooling plate is attached to the interior of the cabinet and houses the ice maker cooling portion which creates ice within the compartments of the mold body by cooling the mold body via the cooling plate. The ice maker is configured to be removably attached to the cooling plate so as to be replaceable without removing the ice maker cooling portion of the refrigerant circuit within the cooling plate or the cooling plate. Again, various options and modifications are possible.

According to still other aspects of the disclosure, a refrigeration appliance with a replaceable direct-cooled ice maker is disclosed including a cabinet and a refrigeration system having a refrigerant circuit for cooling an interior of the cabinet. The refrigerant circuit has an ice maker cooling portion and an ice maker warming portion. A cooling plate is attached to the interior of the cabinet and housing the ice maker cooling portion. An ice maker is removably attached to the cooling plate and includes a mold body defining a plurality of compartments. The ice maker cooling portion is operative to cool the mold body via the cooling plate to form ice within the compartments. The ice maker warming portion is operative to warm the mold body via the cooling plate sufficiently to allow harvesting of ice cubes from the compartments. As above, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
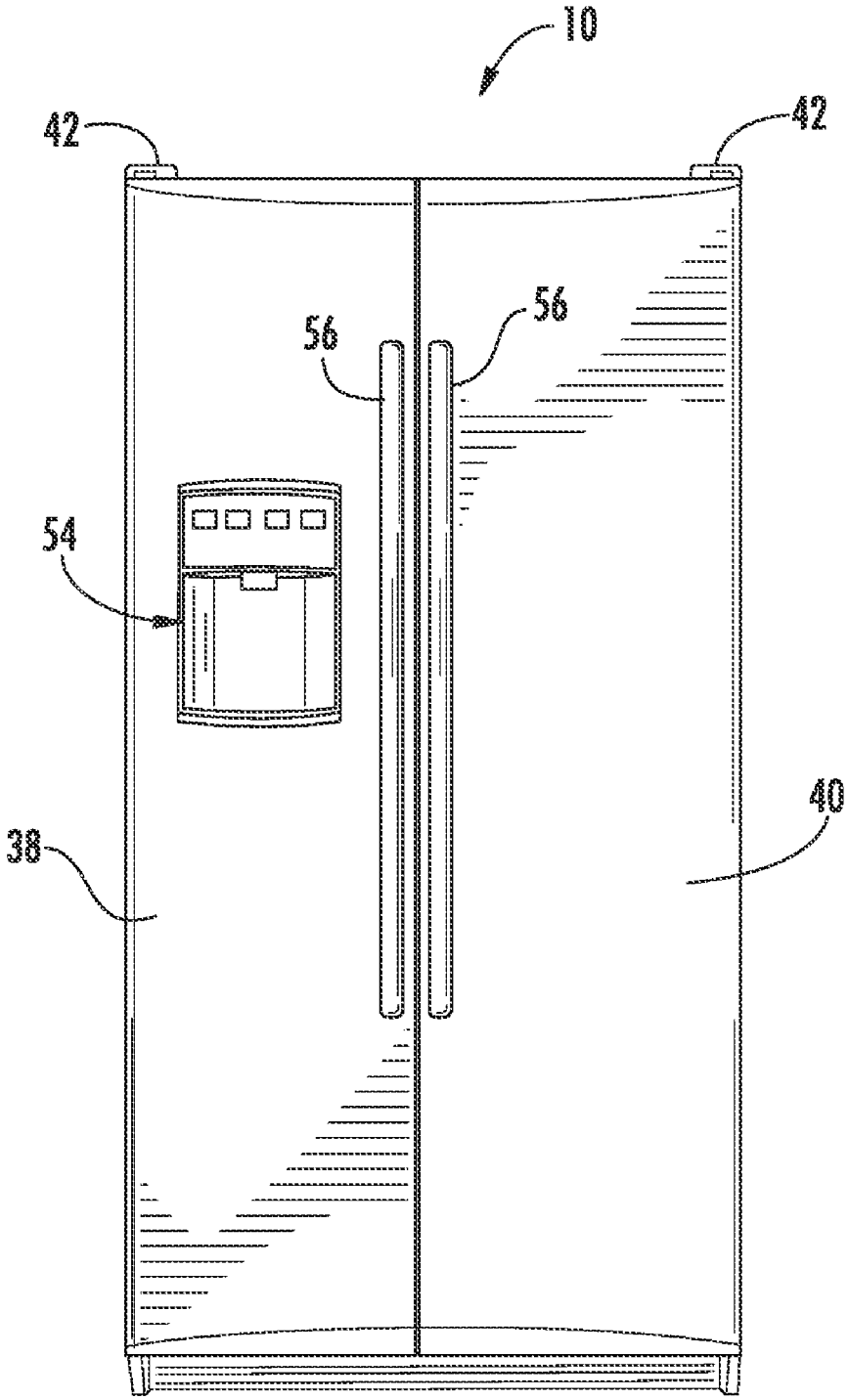
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary refrigeration appliance 10 depicted as a refrigerator in which ice-making assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth.

Figure 2:
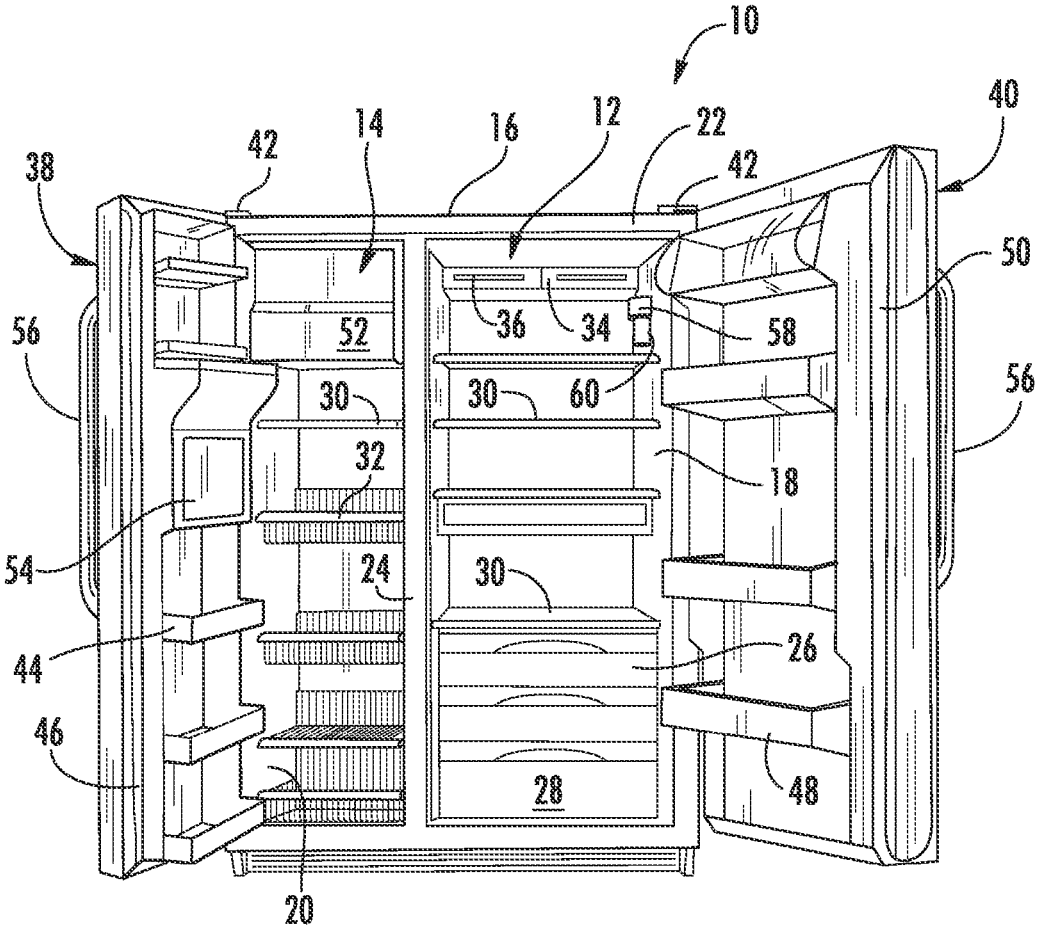
FIG. 2 provides a front view of the refrigeration appliance of FIG. 1 with its doors opened.

Referring to FIG. 2, the refrigerator 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker, as discussed below. Collectively, the vapor compression cycle components in a refrigeration circuit, associated fans, and associated compartments are conventionally referred to as a sealed system. The construction and operation of the sealed system are well known to those skilled in the art.

Figure 3:
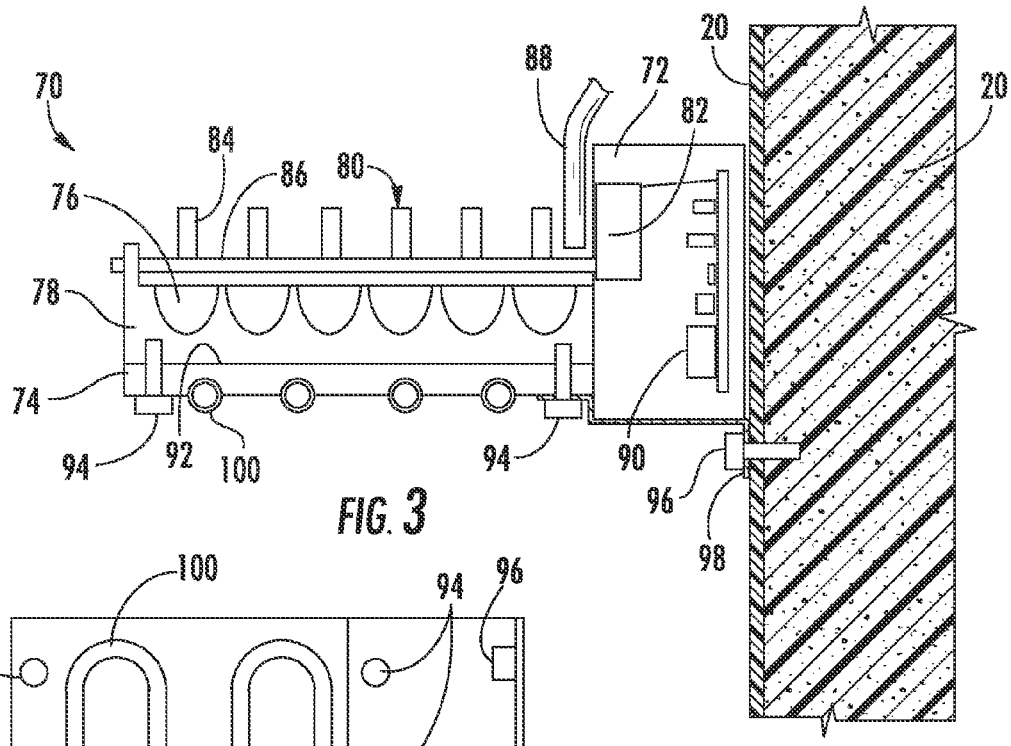
FIG. 3 provides a schematic side view of one direct cooled ice maker according to certain aspects of the present disclosure.

As shown in FIG. 3, ice maker assembly 70 includes an ice maker 72 mounted on a cooling plate 74. Typically, ice maker assembly 70 would be mounted to inner liner wall 20 of freezer compartment 14, although it could be mounted in other locations in any refrigerated compartment. Ice maker 72 makes a number of ice cubes at a time automatically from a water source. Ice maker 72 may therefore make 6-8 cubes per cycle, and over 100 ice cubes per day, for example, in ice cube mold compartments 76 formed within a mold body 78. Ice cubes are dumped periodically into an ice bucket assembly (not shown) in a conventional fashion, for example by virtue of a rotatable ice harvester 80. As shown, harvester 80 includes a motor 82 for driving a number of tines 84 mounted on a rod 86 through ice cube mold compartments 76 to remove the ice cubes once formed. Ice maker 72 also includes a water source 88 for filling compartments 76 once emptied. Ice maker 72 may be connected to a controller 90, which may be a dedicated controller or which may comprise controller 34 mentioned above.

Cooling plate 74 may be made of a substance that readily transmits thermal energy. For example, cooling plate 74 may be a metal such as aluminum. As shown in FIG. 3, cooling plate 74 has a large area of contact 92 with mold body 78 so as to maximize heat transfer from the mold body to the cooling plate to make ice. Therefore, cooling plate 74 allows ice to be formed in mold compartments 76 at a more rapid rate than would otherwise be formed merely sitting within a freezer compartment 14, or within a refrigerator compartment 12 above the freezing temperature.

Cooling plate 74 may be removably attached to ice maker 72 with fasteners 94 such as screws. Cooling plate 74 may also be mounted to a surface such as inner liner wall 20 with additional fasteners 96 and a bracket 98, although the cooling plate could be attached to the inside of the refrigerated compartment in various ways, either removably or permanently.

Cooling plate 74 has a heat exchange tube 100 within it to provide cooling to the plate and in turn mold body 78 to form ice. Tube 100 is within the vapor compression refrigerant cycle, as described below. Tube 100 typically carries refrigerant at a temperature lower than the mold body 78 to draw heat from the mold body to make ice. Tube 100 may also carry warmer refrigerant in some situations to provide a short heating of the mold body 78 to assist in removing ice cubes once formed from individual mold compartments 76.

Figure 4:
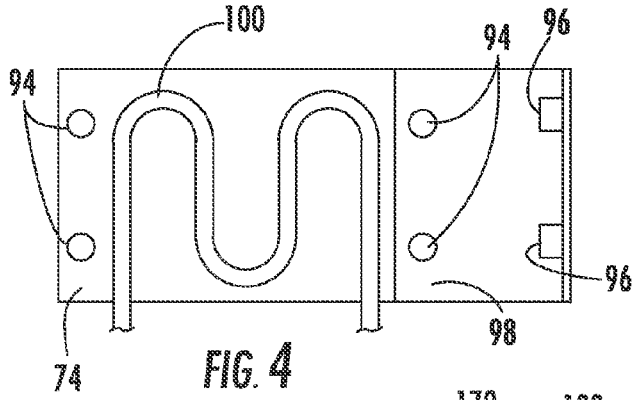
FIG. 4 provides a schematic bottom view of the direct cooled ice maker of FIG. 3.

As shown in FIG. 4, tube 100 may include a number of turns arranged in a serpentine fashion to provide distributed cooling to mold body 78. If desired, fins (not shown) or other known heat transfer enhancing elements could be attached to tube 100 or mold body 78 for enhancing heat transfer between the tube and the mold body. Also, conventional thermal grease may be used as well to further enhance heat transfer between mold body 78 and cooling plate 74.

By placing tube 100 within cooling plate 74 and making ice maker 72 removably attachable to the cooling plate, the ice maker is more readily attachable and replaceable. Therefore in case service or replacement is needed for ice maker 72, it can be done without impacting the refrigerant cycle or in particular damaging tube 100 which is protected by being attached to cooling plate 74 which can stay fixed in place. Therefore, the turns, fins, etc. of tube 100 should not be inadvertently damaged if ice maker 72 is replaced or serviced. This also avoids the potential issue of having to drain, fill or otherwise service the refrigerant cycle if damage occurs.

Figure 5:
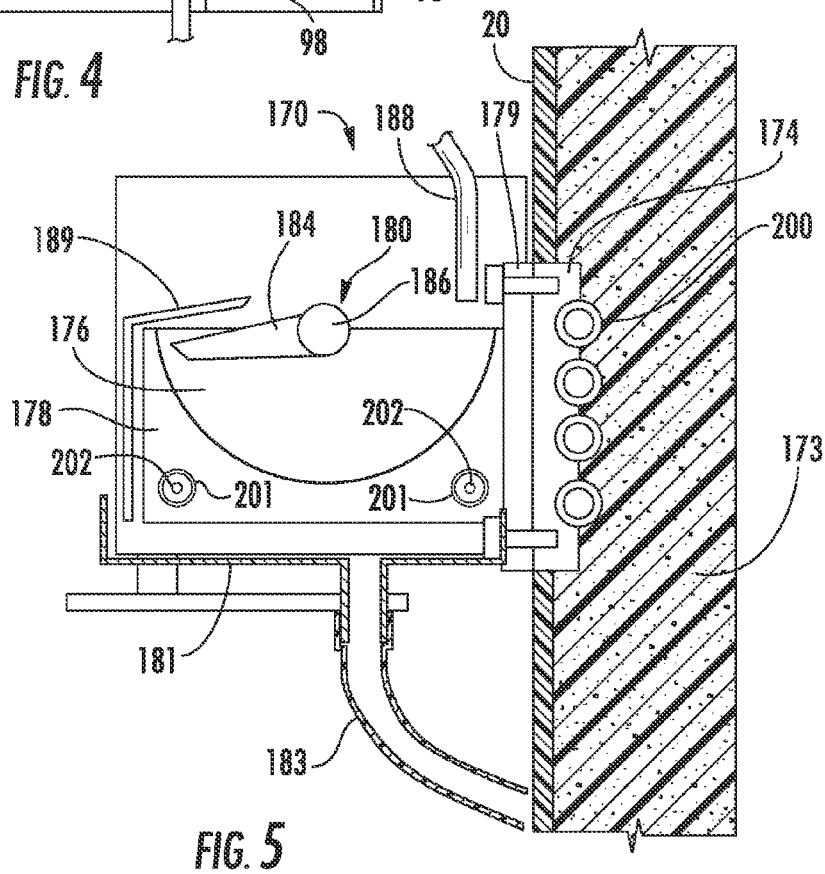
FIG. 5 provides a schematic side view of an alternate direct cooled ice maker according to certain other aspects of the invention.

FIG. 5 shows an alternate ice maker assembly 170 including a cooling plate 174 mounted within a wall of the refrigeration appliance such as liner wall 20. Cooling plate 174 may be embedded within wall 20 within a foamed insulation layer 173. Therefore, cooling plate 174 would be insulated on all sides except for that facing mold body 178 to improve heat transfer from the mold body to the cooling plate. An intermediate heat transfer plate 179 could be employed if desired as part of ice maker 172. Ice maker 172 is attachable to wall 20 by removable fasteners 194 such as screws for ready attachment or detachment for service, as above.

Generally, the operation of ice maker assembly 170 is similar to that above with tube 200 providing heat transfer capabilities relative to mold body 178. Ice harvester 180 is driven with its tines 184 mounted on a rod 186 through ice cube mold compartments 176 to remove the ice cubes once formed. Ice maker 172 also includes a water source 188 for filling compartments 176 once emptied. Ice maker 172 may be connected to a dedicated controller (not shown) or controller 34. A conventional sensor arm 189 may be provided to signal to the controller that an ice bucket (not shown) for receiving the harvested ice cubes is full or jammed, so that ice making may be stopped until come ice cubes are removed and/or the jam is cleared.

If desired, a tube 201 may be provided within mold body 178, either to carry warm fluid from a refrigerant cycle or to house a heating element such as an electrical resistance heater 202. The heating can be used to assist in ice cube harvesting and/or for defrosting. FIG. 5 shows that a drain pan 181 and drain tube 183 may be employed in case of condensation or melting from ice maker 172, for example from ice cube harvesting or defrosting.

Figure 6:
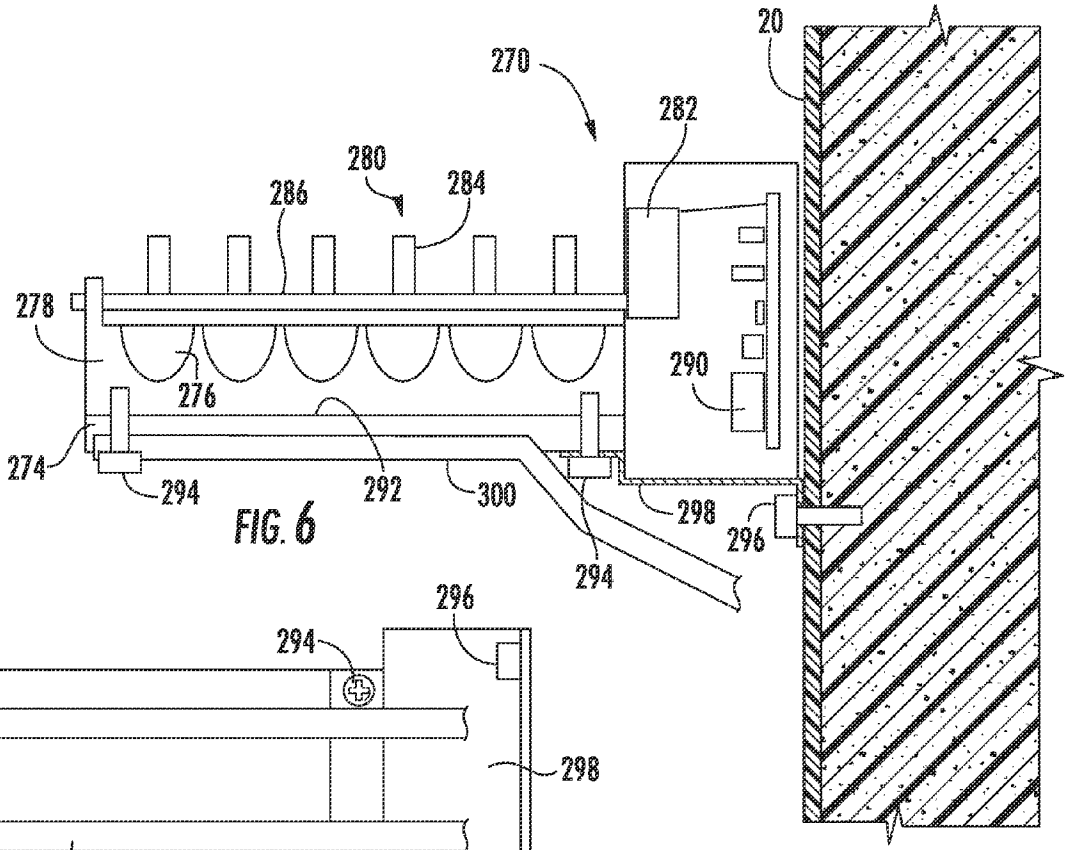
FIG. 6 provides a schematic side view of an alternate direct cooled ice maker according to certain other aspects of the invention.
Figure 7:
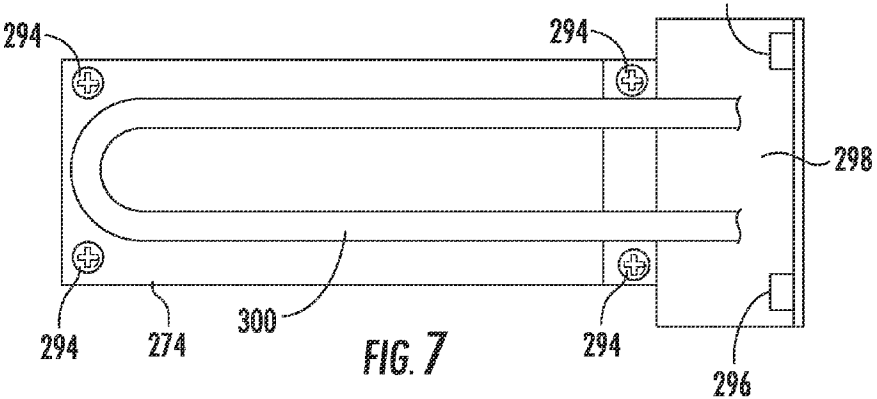
FIG. 7 provides a schematic bottom view of the direct cooled ice maker of FIG. 6.

FIGS. 6 and 7 show another alternate ice maker assembly 270 0 with a cooling tube 300 following a single u-bend path within cooling plate 274. As shown, elements of ice maker assembly 270 may be essentially similar to those shown above with ice maker assemblies 70 and 170. For example, cooling plate 274 is attached to mold body 278 having compartments 276 harvested by a harvester 280 having a motor 282 for driving tines 284 on a rod 286 through the compartments. Fasteners 294 and 296 attach cooling plate 274 to mold body 278 and liner 20 via plate 298, and heat transfer is optimized across interface 292, as above. Controller 290 or 34 may control ice maker assembly 270.

Figure 8:
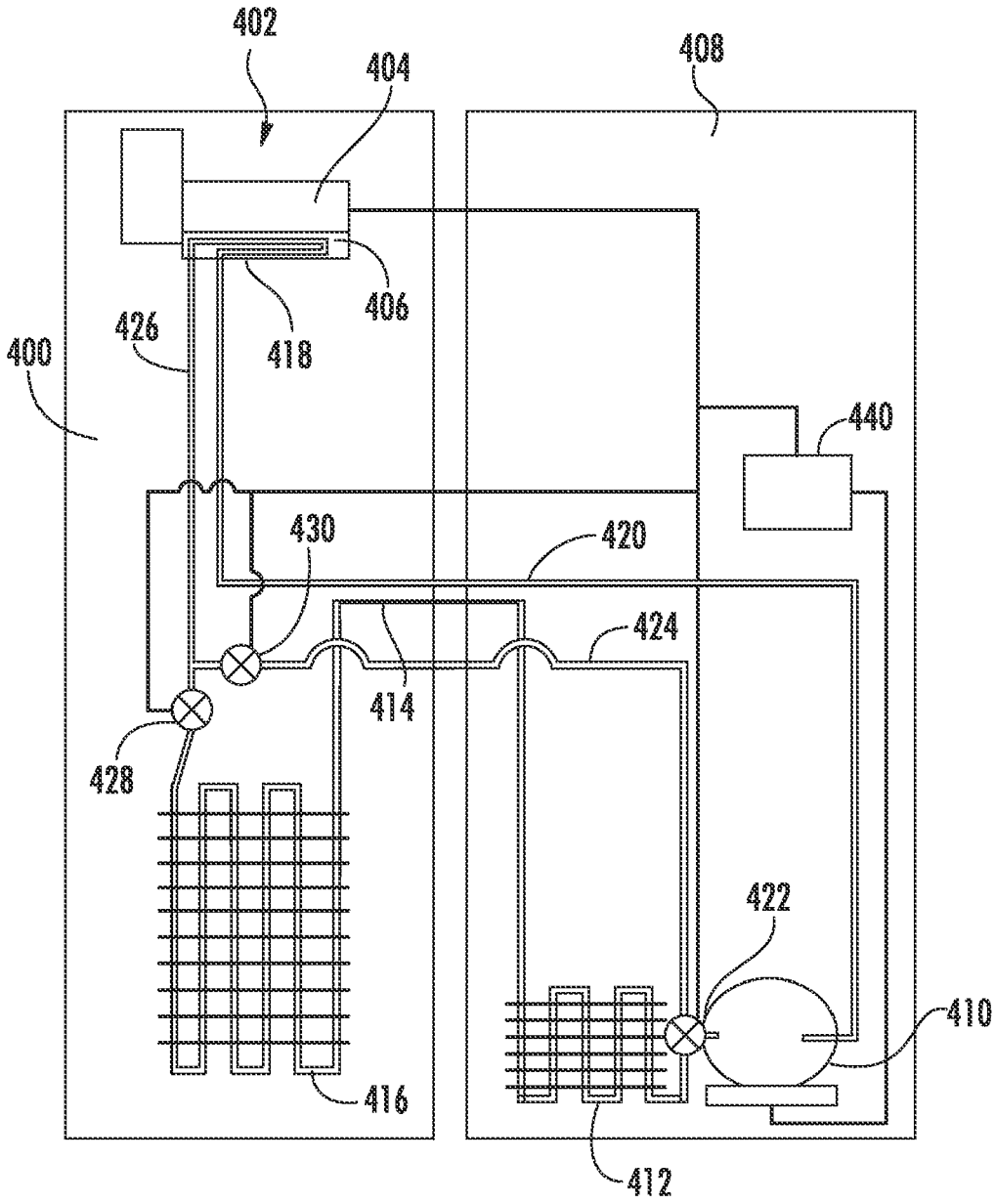
FIG. 8 provides a schematic side view of one possible refrigerant cycle suitable for use with the ice makers of FIGS. 3-7.

FIG. 8 shows one of the many possible examples of a refrigeration cycle that could be employed with the above cooling plates. As shown therein, a refrigerated compartment 400 is provided such as a refrigerator or freezer. An ice making assembly 402 including an ice maker 404 and cooling plate 406 is provided within refrigerated compartment 400. Portion 408 of the system is outside of refrigerated compartment 400, either within or on the outside of the refrigeration appliance.

FIG. 8 shows a typical refrigeration cycle for a cold plate ice maker, and also includes an added optional fluid bypass for ice cube harvesting. As shown, the typical cycle includes a compressor 410, a condenser 412, an expansion device 414, an evaporator 416, a cooling plate loop 418, and a return 420 to the compressor. During normal operation the refrigerant travels in this cycle. Cooling plate loop 418 (corresponding to the various cooling plate tubes above) cools the water in ice maker 404 to rapidly form ice therein. If desired, an electrical resistance heater as described above or other heat source could be used for harvesting and/or defrosting. A controller 440 (or controller 34) controls the system.

Cooling plate loop 418 can also receive warm refrigerant in an alternate flow path to warm the mold body of ice maker 404 for ice cube harvesting. To do so, controller 440 signals two-way valve 422 to switch direction causing warm fluid exiting compressor 410 to travel along alternate path 424 instead of entering condenser 412. The warm fluid then enters path portion 426 (which is common to the cooling path), cooling plate loop 418, and return 420. As options, a valve 428 can be present between common path portion 426 and evaporator 416 to prevent cold refrigerant from mixing undesirably with the warm fluid during heating operation, and a valve 430 can be present in path portion 424 to prevent warm fluid from undesirably mixing with the cold fluid during normal cooling operation. Each of valves 422, 428 and 430, compressor 310, and ice maker assembly 402 are all in communication with controller 440 as shown.

It should be understood that the heating loop is optional. It should also be understood that various arrangements of refrigeration cycles are possible.

Figure 9:
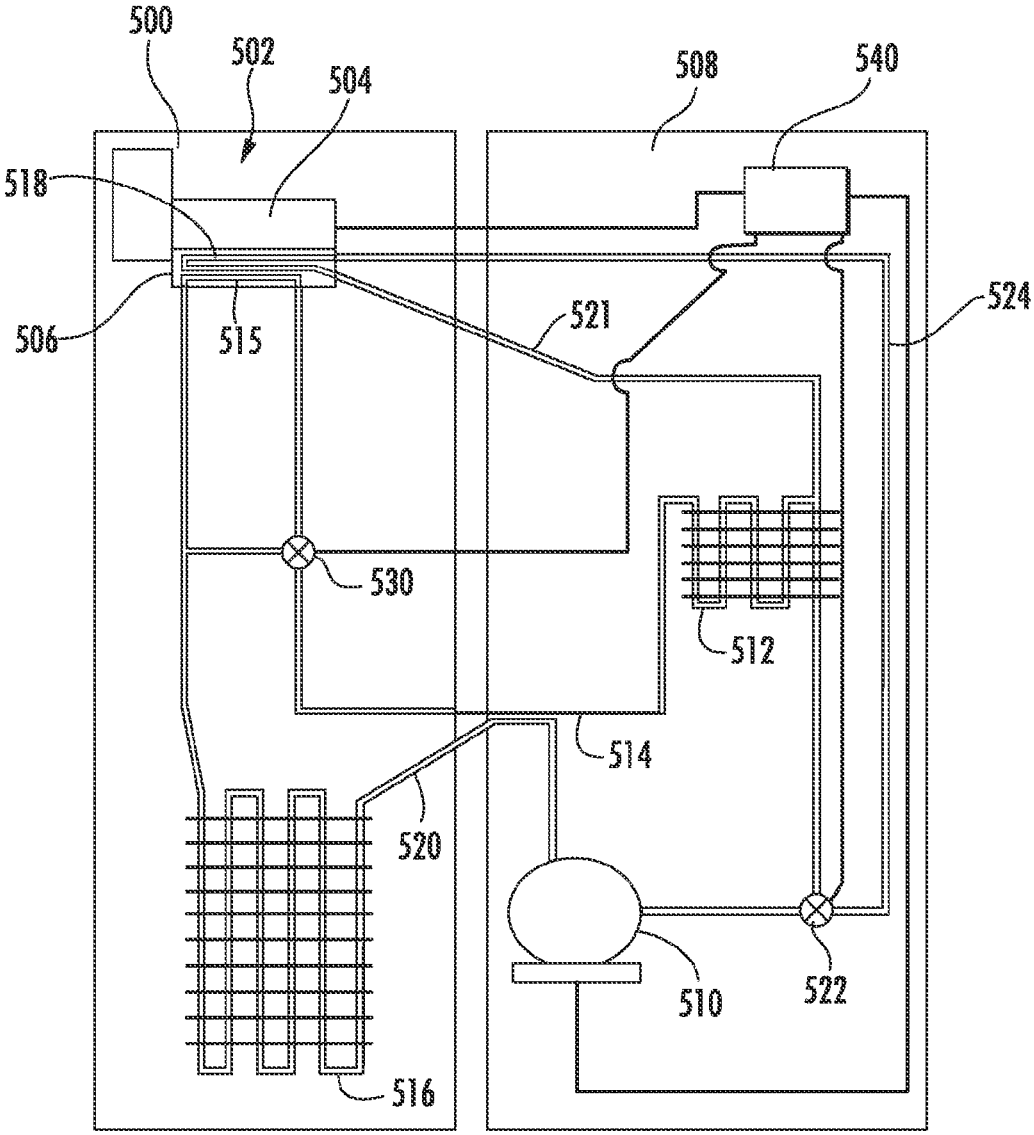
FIG. 9 provides a schematic side view of an alternate refrigerant cycle, with a separate heating loop through the cold plate.
Figure 10:
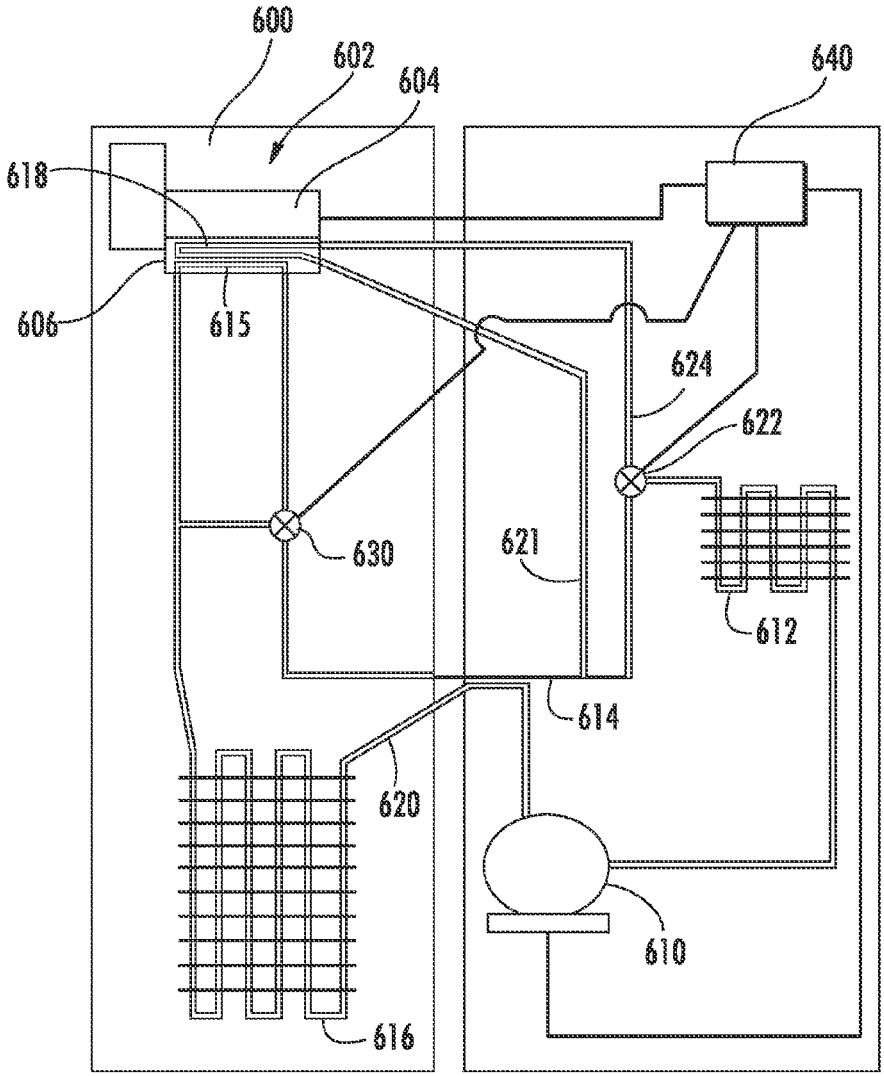
FIG. 10 provides a schematic side view a second alternate refrigerant cycle with a separate heating loop through the cold plate.

For example, FIGS. 9 and 10 show two alternate cycles where a separate heating and cooling loop are provided through the cold plate, rather than using the common portion for both as above. In FIG. 9, refrigerated compartment 500 is provided with ice making assembly 502 including an ice maker 504 and cooling plate 506. Portion 508 of the system is outside of refrigerated compartment 500, as above.

A compressor 510, a condenser 512, an expansion device 514, a cooling plate loop 515, an evaporator 516, and a return 520 to the compressor are provided. During normal operation the refrigerant travels in this cycle. Cooling plate loop 515 cools the water in ice maker 504. A controller 540 (or controller 34) controls the system.

Heating loop 518 can receive warm refrigerant in an alternate flow path to warm the mold body of ice maker 504 for ice cube harvesting and/or defrosting. To do so, controller 540 signals two-way valve 522 to switch direction causing warm fluid exiting compressor 510 to travel along alternate path 524 instead of entering condenser 512. The warm fluid then enters cooling plate heating loop 518 and return 521 which leads to at least a portion of condenser 512. As options, a valve 530 can be present between expansion device 514 and cooling plate 506 to bypass cold refrigerant to evaporator 516. Such by pass allows continued cooling of refrigerated compartment 500 and prevents cold refrigerant from traveling through cold plate 506 when melting or defrosting is desired. Each of valves 522 and 530, compressor 510, and ice maker assembly 502 are all in communication with controller 540 as shown. Other flow control valves could also be employed if necessary.

Therefore, the system of FIG. 9 allows for cooling to occur continuously within the refrigerated compartment during the cold plate heating cycles. The system of FIG. 9 also allows for continued cooling of the refrigerated compartment (and advantageously not the ice maker/cooling plate) if the ice maker is to be shut off, for example if a device such as arm 189 above detects that an ice bucket is full or jammed and the controller stops ice making, or during heating and harvesting.

FIG. 10 shows a variant where the valve corresponding to valve 522 is moved to downstream of the condenser. In FIG. 10, refrigerated compartment 600 is provided with ice making assembly 602 including an ice maker 604 and cooling plate 606. Portion 608 of the system is outside of refrigerated compartment 600, as above.

A compressor 610, a condenser 612, an expansion device 614, a cooling plate loop 615, an evaporator 616, and a return 620 to the compressor are provided. As above normal operation the refrigerant travels in this cycle. Cooling plate loop 615 cools the water in ice maker 604. A controller 640 (or controller 34) controls the system.

Heating loop 618 can receive warm refrigerant as above for ice cube harvesting and/or defrosting. Here, controller 640 signals two-way valve 622 to switch direction causing warm fluid exiting condenser 612 to travel along alternate path 624 instead of entering evaporator 614. The warm fluid then enters cooling plate heating loop 618 and return 621 which leads to at least a portion of evaporator 614. As options, a valve 630 can be present between expansion device 614 and cooling plate 606 to bypass cold refrigerant to evaporator 616. Such bypass allows continued cooling of refrigerated compartment 600 and prevents cold refrigerant from traveling through cold plate 606 when melting or defrosting is desired, as above. Each of valves 622 and 630, compressor 610 and ice maker assembly 602 are all in communication with controller 640 as shown. Other flow control valves could also be employed if necessary.

Therefore, the system of FIG. 10 also allows for cooling to occur continuously within the refrigerated compartment during the cold plate heating cycles and if the ice maker is shut off. It also allows for the cold plate cooling loop to be deactivated if desired during pauses in or stoppages of ice making.

Figure 11:
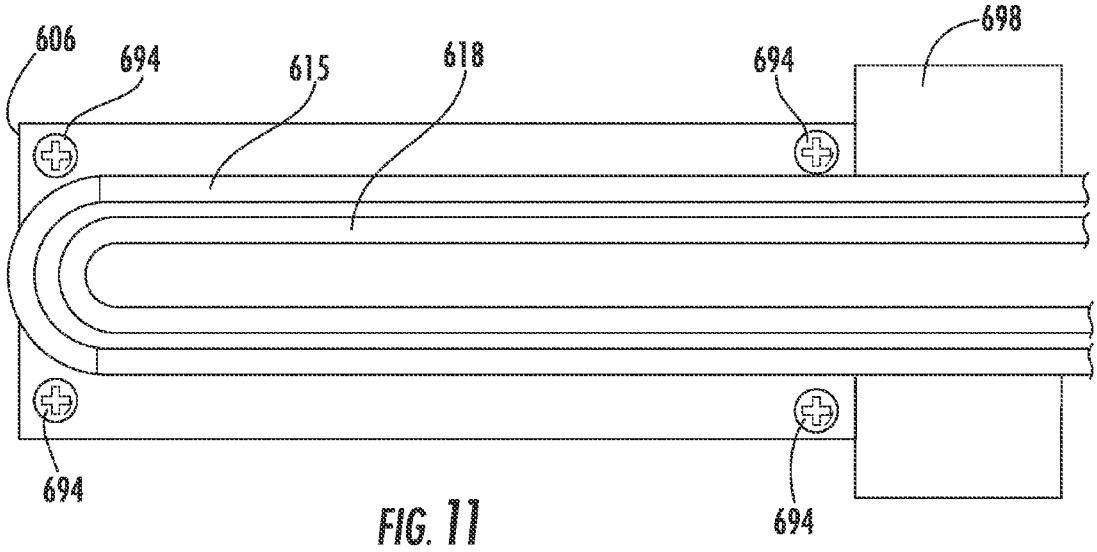
FIG. 11 provides a schematic bottom view of one example of a direct cooled ice maker with a separate heating loop through the cold plate as in FIG. 10.

FIG. 11 provides a schematic view of one example of a cooing plate 606 having a cooling loop 615 and heating loop 618, as above. Screws 694 and plate 698 or the like may be used to mount an ice maker to cooling plate and to the mount cooling plate to a refrigerated compartment as above. It should be understood that different paths could be used for loops 615 and 618, and that any such dual loop system could be applied to any of the embodiments above.

In view of the above, an ice making assembly is disclosed having a cooling plate for rapidly cooling water to form ice. The ice maker can be removably attached to the cooling plate, which can be useful during service in simplifying, reducing cost and preventing inadvertent damage. An optional heating loop can be added as well using the same tubes that are within cooling plate, or an alternate loop, to assist in harvesting ice cubes. In such systems with heating loops, controls can be provided to allow for continued cooling of the refrigerated compartment during ice harvest or ice cube maker shut down, while the cooling loop to the ice maker is deactivated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A direct-cooled ice making assembly for a refrigeration appliance comprising:

an ice maker including a mold body defining a plurality of compartments for forming ice cubes therein;

a refrigeration system including a refrigerant circuit, the refrigerant circuit having an ice maker cooling portion for cooling the ice maker mold body; and a cooling plate housing the ice maker cooling portion, the ice maker cooling portion creating ice within the compartments of the mold body by cooling the mold body via the cooling plate, the ice maker configured to be removably attached to the cooling plate so as to be replaceable without removing the ice maker cooling portion of the refrigerant circuit within the cooling plate or the cooling plate.

2. The direct-cooled ice making assembly of claim 1, wherein the cooling plate is configured for horizontal attachment to the refrigeration appliance and the ice maker is attached to a top surface of the cooling plate.

3. The direct-cooled ice making assembly of claim 1, wherein the cooling plate is configured for vertical attachment to the refrigeration and the ice maker is attached to a side surface of the cooling plate.

4. The direct-cooled ice making assembly of claim 1, wherein the cooling plate is attached to the refrigeration appliance via a bracket.

5. The direct-cooled ice making assembly of claim 1, wherein the cooling plate is attached to the refrigeration appliance via a foamed-in attachment.

6. The direct-cooled ice making assembly of claim 1, wherein the refrigerant circuit includes a warming portion for selectively directing warm refrigerant to the cooling plate.

7. The direct cooled ice making assembly of claim 6, wherein a bypass valve is provided in the refrigerant loop to control flow through the warming portion.

8. The direct cooled ice making assembly of claim 6, further including a drain pan beneath the mold body to catch and direct away any condensation created by the warming portion of the refrigerant circuit.

9. The direct cooled ice making assembly of claim 1, wherein the refrigerant circuit further includes at least one refrigerator cooling portion for cooling an interior portion of the refrigeration appliance.

10. A refrigeration appliance with a replaceable direct-cooled ice maker, the refrigeration appliance comprising:

a cabinet;

an ice maker within an interior of the cabinet including a mold body defining a plurality of compartments for forming ice cubes therein;

a refrigeration system including a refrigerant circuit for cooling the interior of the cabinet, the refrigerant circuit having an ice maker cooling portion for cooling the ice maker mold body; and a cooling plate attached to the interior of the cabinet and housing the ice maker cooling portion, the ice maker cooling portion creating ice within the compartments of the mold body by cooling the mold body via the cooling plate, the ice maker configured to be removably attached to the cooling plate so as to be replaceable without removing the ice maker cooling portion of the refrigerant circuit within the cooling plate or the cooling plate.

11. The refrigeration appliance of claim 10, wherein the cooling plate is configured for horizontal attachment to the cabinet and the ice maker is attached to a top surface of the cooling plate.

12. The refrigeration appliance of claim 10, wherein the cooling plate is configured for vertical attachment to the cabinet and the ice maker is attached to a side surface of the cooling plate.

13. The refrigeration appliance of claim 10, wherein the cooling plate is attached to the cabinet via a bracket.

14. The refrigeration appliance of claim 10, wherein the cooling plate is attached to the cabinet via a foamed-in attachment.

15. The refrigeration appliance of claim 10, wherein the refrigerant circuit includes a warming portion for selectively directing warm refrigerant to the cooling plate.

16. The refrigeration appliance of claim 15, wherein a bypass valve is provided in the refrigerant loop to control flow through the warming portion.

17. A refrigeration appliance with a replaceable direct-cooled ice maker, the refrigeration appliance comprising:

a cabinet;

a refrigeration system including a refrigerant circuit for cooling an interior of the cabinet, the refrigerant circuit having an ice maker cooling portion and an ice maker warming portion;

a cooling plate attached to the interior of the cabinet and housing the ice maker cooling portion; and an ice maker removably attached to the cooling plate and including a mold body defining a plurality of compartments, the ice maker cooling portion operative to cool the mold body via the cooling plate to form ice within the compartments, the ice maker warming portion operative to warm the mold body via the cooling plate sufficiently to allow harvesting of ice cubes from the compartments.

18. The refrigeration appliance of claim 17, wherein the refrigerant circuit includes a warming portion for selectively directing warm refrigerant to the cooling plate.

19. The refrigeration appliance of claim 18, wherein the refrigerant circuit includes valving to direct cold refrigerant through an evaporator within the interior of the cabinet and not through the cooling loop when warm refrigerant is directed to the cooling plate.

20. The refrigeration appliance of claim 18, wherein the refrigerant circuit includes valving to direct cold refrigerant through an evaporator within the interior of the cabinet and not through the cooling loop when the ice maker is not making ice.

* * * * *